US012491608B2

(12) United States Patent
Horl

(10) Patent No.: US 12,491,608 B2
(45) Date of Patent: Dec. 9, 2025

(54) ROLLER SANDER

(71) Applicant: HORL 1993 GMBH, Freiburg (DE)

(72) Inventor: Timo Horl, Freiburg (DE)

(73) Assignee: HORL 1993 GMBH (DE)

( * ) Notice: Subject to any disclaimer, the term of this patent is extended or adjusted under 35 U.S.C. 154(b) by 622 days.

(21) Appl. No.: 17/909,603

(22) PCT Filed: Mar. 9, 2021

(86) PCT No.: PCT/EP2021/055861
§ 371 (c)(1),
(2) Date: Sep. 6, 2022

(87) PCT Pub. No.: WO2021/180687
PCT Pub. Date: Sep. 16, 2021

(65) Prior Publication Data

US 2023/0108809 A1 Apr. 6, 2023

(30) Foreign Application Priority Data

Mar. 11, 2020 (DE) ..... 10 2020 203 144.4

(51) Int. Cl.
*B24D 15/08* (2006.01)
*B24B 3/54* (2006.01)
*B24D 7/16* (2006.01)

(52) U.S. Cl.
CPC ..... *B24D 15/08* (2013.01); *B24B 3/543* (2013.01); *B24D 7/16* (2013.01); *B24D 15/084* (2013.01); *B24D 15/085* (2013.01)

(58) Field of Classification Search
CPC .. B24D 15/085; B24D 15/084; B24D 15/063; B24D 15/065; B24B 3/36; B24B 3/48;
(Continued)

(56) References Cited

U.S. PATENT DOCUMENTS 909,097 A * 1/1909 Leslie ..... B24B 3/00 451/232
1,027,045 A * 5/1912 Hanson ..... B24B 3/38 451/344

(Continued)

FOREIGN PATENT DOCUMENTS

CN 204686618 U 10/2015
CN 110091235 A 8/2019

(Continued)

OTHER PUBLICATIONS

EP_3278928_A2_I English Translation (Year: 2018).*

(Continued)

*Primary Examiner* — Makena S Markman
(74) *Attorney, Agent, or Firm* — Harness, Dickey & Pierce, P.L.C.

(57) ABSTRACT

A device for grinding and/or polishing a cutting edge of a cutting tool. The device includes a handle, at least one roller rotatable relative to the handle, and at least one disc that is rotatable relative to the handle for grinding and/or polishing the cutting edge of the cutting tool. The device can be moved over a substrate by exerting force on the handle so that the roller, which is rotating relative to the handle, rolls on the substrate and the disc can be set in rotation. The disc may be rotatable at a different rotational speed/angular velocity to the roller.

16 Claims, 1 Drawing Sheet

(58) Field of Classification Search
CPC .... B24B 3/50; B24B 3/52; B24B 3/54; B24B 3/543; B24B 47/12
See application file for complete search history.

(56) References Cited

U.S. PATENT DOCUMENTS

| | | | | | |
|---|---|---|---|---|---|
| 1,388,882 | A * | 8/1921 | Paul | B24D 15/08 D8/93 |
| 2,477,075 | A | 7/1949 | Miller | |
| 4,672,778 | A * | 6/1987 | Rieser | B24D 15/081 451/486 |
| 5,474,504 | A † | 12/1995 | Bay | |
| 6,099,433 | A † | 8/2000 | Brouwer | |
| 2020/0254580 | A1 * | 8/2020 | Valentini | B24B 41/04 |

FOREIGN PATENT DOCUMENTS

| | | | |
|---|---|---|---|
| DE | 4443625 | A1 | 6/1996 |
| DE | 29703326 | U1 | 6/1997 |
| EP | 3278928 | A2 † | 2/2018 |
| FR | 1469819 | A † | 2/1967 |
| GB | 264198 | A † | 1/1927 |
| GB | 437733 | A | 10/1935 |
| GB | 675949 | A | 7/1952 |
| PL | 152220 | B1 † | 11/1990 |

OTHER PUBLICATIONS

Notification of Reasons for Refusal for corresponding Japanese Patent Application No. 2022-554778 dated Nov. 7, 2023, with English translation (7 Pages).
Office Action issued in corresponding Austrailian Patent Application No. 2021233125 dated Sep. 7, 2023 (3 Pages).
Office Action issued in corresponding Israel Patent Application No. 296323, issued Mar. 24, 2025 (English translation) (4 pages).
Office Action issued in corresponding Canadian Patent Application No. 3174468, issued Nov. 28, 2023 (4 pages).
International Search Report (English and Deutsch) issued in PCT/EP2021/055861, mailed Jun. 24, 2021; ISA/EP (6 pages).
Office Action issued in corresponding Korean Patent Application 10-2022-7035044, dated Oct. 10, 2024, with translation of Grounds for Rejection; (4 pages).
Office Action issued in corresponding Chinese Patent Application 202180020920.8, dated Sep. 28, 2024; (16 pages).
Office Action issued in corresponding Korean Patent Application No. 10-2022-7035044 dated Jul. 24, 2024, with English translation (6 Pages).
Office Action issued in corresponding Chinese Patent Application 202180020920.8, issued Jan. 25, 2025; (10 pages).
Office Action issued in corresponding Chinese Patent Application No. 202180020920.8, mailed on Mar. 28, 2024 (21 pages).
Notification to Complete Formalities of Registration issued in corresponding Chinese Patent Application 2021800209208, dated Apr. 25, 2025, with English translation (9 pages).
Author: DonCaruso BBQ title: Messer richtig schärfen, der Rollschleifer von HORL publication date: Aug. 9, 2017 place of publication: Youtube (https://www.youtube.com/watch?v=jnuoVJfLefo).†

* cited by examiner
† cited by third party

ROLLER SANDER

CROSS REFERENCE TO RELATED APPLICATIONS

This application is a U.S. National Phase Application under 35 U.S.C. 371 of International Application No. PCT/EP2021/055861, filed on Mar. 9, 2021, which claims priority to German Patent Application No. 10 2020 203 144.4, filed on Mar. 11, 2020. The entire disclosures of the above applications are expressly incorporated by reference herein.

BACKGROUND

Technical Field

The present invention relates to a device for grinding and/or polishing a cutting edge of a cutting tool, preferably a household knife, comprising a handle and at least one disc for grinding and/or polishing the cutting edge of the cutting tool. When the device is drawn along a surface, such as a table surface, by handling it by the handle, the disc rotates relative to the handle. When the cutting edge of the cutting tool is thereby applied to the disc, the disc grinds the applied cutting edge due to its rotation.

Related Art

Corresponding devices, also known as "roller grinders", are known from patent documents DE 297 03 326 U1 and EP 3 278 928 A2. With such devices, a particularly uniform grinding of the cutting edge of the cutting tool can be achieved.

The present invention is based on the object of further improving the grinding and/or polishing effect of corresponding devices.

SUMMARY

The device according to the invention serves for grinding and/or polishing a cutting edge of a cutting tool, preferably a household knife, and comprises: a handle, at least one roller rotatable relative to the handle, and at least one disc rotatable relative to the handle for grinding and/or polishing the cutting edge of the cutting tool, wherein the device is movable over a base by exerting force on the handle, so that the roller—rotating relative to the handle—rolls on the base and the disc can (preferably thereby) be set in rotation wherein the disc is rotatable at a different rotational speed/angular velocity than the roller. Due to the different rotational speed of the disc with respect sub-spec clean to the roller, the grinding effect can be specifically adjusted to individual requirements. For example, by increasing the rotational speed of the disc relative to the rotational speed of the roller, an increase in the grinding and/or polishing effect can be achieved by the disc rotating faster than the roller rolls on the base. By reducing the rotational speed of the disc relative to the rotational speed of the roller, a particularly precise grinding and/or polishing operation is made possible. Preferably, the ratio of the directions of rotation and/or the ratio of the rotational speed/angular velocities of the disc and the roller can/can be adjusted, for example by means of an adjustable gear ratio or gear reduction, comparable to a gear shift. The rotation of the disc can be temporally and/or mechanically coupled to the rotation of the roller, e.g. when the disc is driven by a transmission coupled to the roller, or decoupled from the rotation of the roller, e.g. when the disc is driven by an electric motor or a spring winder motor. Preferably, the rotation of the disc is causally related to the rotation of the roller, such as when the disc is driven by a transmission coupled to the roller or when the disc is driven by a spring winder motor. The spring winder motor can be wound, for example, by rotation of the roller relative to the handle and/or the disc, and the energy stored in the spring winder motor can then be released by rotation of the disc independently of the rotation of the roller. To this extent, the rotation of the disc, although it may be shifted in time with respect to the rotation of the roller, is caused by the rotation of the roller because the spring winder motor could not otherwise provide energy to drive the rotation of the disc. However, it is also possible for the roller and the disc to rotate completely independently of each other relative to the handle, e.g., when the disc is driven by an electric motor while the roller is standing still.

It can be advantageous if the disc rotates at a different, preferably higher, rotational speed/angular velocity than the roller when the roller rotates relative to the handle, whereby preferably the rotational speed/angular velocity of the disc is at least 50% higher, particularly preferably at least 100% higher, than the rotational speed/angular velocity of the roller. In this embodiment, even a comparatively short rolling movement of the roller results in a significantly improved grinding or polishing effect than with conventional roller grinders, because the wheel rotates faster in relation to the roller.

However, it may also prove useful if the disc rotates in the same or opposite direction to the direction of rotation of the roller when the roller rotates relative to the handle. In particular, it may be advantageous if the disc always rotates in the same direction when the roller rotates, regardless of the direction of rotation of the roller. This can be accomplished, for example, by means of a one-way clutch. In this way, a particularly uniform grinding or polishing effect can be achieved.

It can be advantageous if the disc rotates with a fixed or adjustable transmission ratio relative to the disc when the disc rotates relative to the handle. This additionally facilitates the achievement of a particularly uniform grinding or polishing effect.

It may be useful if the rotational movements of the roller and the disc are coupled via a transmission, preferably via a gear drive, preferably via a planetary gear. In this way, the rotational movement of the disc can be coupled particularly reliably and proportionally to the rotational movement of the roller.

It may be useful if the transmission comprises two coaxial central gears and at least one transmission gear motion-coupled to the central gears, preferably the roller and the disc each being connected or non-rotatably coupled to one of the central gears, preferably an axis of rotation of the at least one transmission gear being offset from the axes of rotation of the central gears relative to the handle. Preferably, the central gears are in mesh via the transmission gear, so that a rotation of the roller is converted into a rotation of the transmission gear, and the latter into a rotation of the disc.

It may be helpful if the roller has internal teeth wherein the roller is preferably configured as a ring gear. With this configuration, the transmission can be accommodated particularly compactly in the roller.

However, it can also be practical if the device has an axle which is rotatably mounted on or in the handle and which is preferably set in rotation when the roller is rotated relative to the handle, the disc preferably being connected to the axle in a rotationally fixed and/or detachable manner, the roller in particular preferably being rotatably mounted on the axle. With this configuration, a high transmission ratio between the roller and the disc can be achieved in a particularly simple and compact manner.

It may be useful if the handle, the roller and/or the disc and possibly the axle are arranged coaxially to each other. This arrangement proves to be particularly compact and stable.

It may prove expedient if the axes of rotation of the roller and the disc and possibly the axis coincide, preferably with a center axis of the handle. This arrangement also proves to be particularly compact and stable. In this embodiment, the grinding wheel can occupy the entire end face of the device.

It may be helpful if one disc is arranged on each of the two end faces of the device, preferably with one roller arranged between each disc and the handle, preferably with each of the two discs having its own drive, particularly preferably coupled via its own transmission to the roller arranged between the disc and the handle. In this embodiment, for example, discs with different coatings can be used, for example for grinding and polishing the cutting tool. The end faces preferably form the axial end faces of the device and extend in planes perpendicular to its center axis.

It may be useful if the handle, roller and disc have exactly or substantially identical external diameters, preferably such that the shell surfaces of the handle, roller and disc are flush with each other. This embodiment has an attractive aesthetic appearance and reduces the risk of injury to a user because there are only small gaps between the rotating parts and no protruding rotating parts. Ideally, the shell surfaces of the handle, the roller and the disc are exactly or substantially cylindrical.

It may be advantageous if the roller has a circumferential ring (preferably rubber ring or silicone ring), which is preferably arranged in at least one groove on the outer circumference of the roller, whereby preferably the ring has the largest diameter with respect to an axis of the device (of all components of the device), so that the ring rolls on the base when the device is moved over the base. The ring, particularly a rubber ring in the embodiment, can accomplish slip-free rolling of the rollers on the base due to its elastic properties. Optionally, the ring can be reversibly transferred from the groove on the outer circumference of the roller into a groove on the outer circumference of the roller, so that when the device is moved over a base by exerting force on the handle, the disc—rotating relative to the handle—rolls on the base and is thereby set in rotation. In this case, the device does not roll on the roller, but on the disc. Preferably, the ring is optionally arranged in one of a plurality of grooves on the outer circumference of the roller, the grooves having different diameters, the ring having the largest diameter in each of these grooves with respect to an axis of the device (of all components of the device), so that the ring rolls on the base when the device is moved over the base. Due to the different diameters, the rolling range of the roller—and thus the transmission ratio between the roller and the disc—can be changed in a particularly simple manner. In order to be able to be arranged in the different grooves on the outer circumference of the roller, it is advisable to use a particularly elastic ring, e.g. made of rubber, which can be stretched accordingly and adapts to the corresponding outer diameters of the grooves.

It can be practical if the roller is rotatably mounted on the axle which is rotatably mounted on or in the handle. This configuration proves to be particularly compact.

Another aspect of the present invention relates to a system comprising the above-described device and a device for fixing the cutting edge of the cutting tool relative to the disc during grinding and/or polishing, preferably such that a flank and/or extension plane of the cutting edge of the cutting tool is oriented relative to (a surface of) the disc at an angle in the range from 5 to 30°, preferably in the range from 10° to 20°, preferably 15°. In this way, a particularly uniform grinding and/or polishing result can be achieved.

Other advantageous further embodiments are mentioned below:

Preferably, the device comprises at least one of the following features:

- The device is formed as a roller grinder.
- The device has an approximately cylindrical outline.
- The device has two flat, preferably parallel end faces.
- The device has a length in the range of 5 cm to 15 cm, preferably in the range of 3 cm to 12 cm.
- The device has a diameter in the range of 2 cm to 15 cm, preferably in the range of 3 cm to 12 cm, more preferably in the range of 4 cm to 8 cm.

The handle preferably comprises at least one of the following features:

- The handle is hollow cylindrical.
- The handle has a length in the range of 3 cm to 10 cm, preferably in the range of 5 cm to 8 cm.
- The handle has a diameter in the range of 2 cm to 15 cm, preferably in the range of 3 cm to 10 cm, more preferably in the range of 4 cm to 8 cm.
- The external diameter of the handle corresponds to the external diameter of the roller and/or the disc.
- A shell surface of the handle and a shell surface of the roller are arranged flush with each other.
- The handle extends along an axis which is also the axis of rotation of the roller and/or the axis of rotation of the disc.
- The handle is made of wood or metal or a combination of wood and metal.
- The handle has an exactly or substantially cylindrical shell surface.
- The handle has an exactly or substantially cylindrical bore.

The roller preferably comprises at least one of the following features:

- The roller is formed in the shape of a bush or sleeve.
- The roller has a length in the range of 0.5 cm to 5 cm, preferably in the range of 1 cm to 3 cm.
- The roller has a diameter in the range of 2 cm to 15 cm, preferably in the range of 3 cm to 10 cm, more preferably in the range of 4 cm to 8 cm.
- A shell surface of the roller and a shell surface of the disc are arranged flush with each other.
- The roller is made of wood or metal or a combination of wood and metal.
- The roller has at least one circumferential groove in the circumferential surface, preferably for receiving a ring, such as a rubber ring, preferably several circumferential grooves with different diameters.
- An inner diameter of the roller is smaller on one side than on the other side, preferably smaller on a side facing the disc than on a side facing the handle.
- The roller has internal teeth, preferably on the side with the larger internal diameter.

The disc preferably comprises at least one of the following features:

- On a side facing away from the end face, the disc comprises an integrally formed and/or integrally, preferably monolithically, formed threaded pin, with which the disc is preferably screwed to an axle rotatably mounted on or in the handle.

The disc (with the exception of the threaded pin) has a length in the range of 0.2 cm to 2 cm, preferably in the range of 0.5 cm to 1 cm.

The disc has a diameter in the range of 2 cm to 15 cm, preferably in the range of 3 cm to 10 cm, more preferably in the range of 4 cm to 8 cm.

A shell surface of the disc and a shell surface of the roller are arranged flush with each other.

The disc is made of metal.

The disc has a grinding and/or polishing surface on the end face.

The disc has a grinding and/or polishing coating on the end face, preferably made of diamond.

The disc has a chamfer or rounding at the transition between the shell surface and the grinding and/or polishing surface.

The end face of the disc extends exactly or substantially in a plane.

The disc is arranged on one end face of the device.

One disc is arranged at each of the two ends of the device.

The transmission preferably comprises at least one of the following features:

The transmission is formed as a gear drive.

The transmission is formed as a planetary gear.

The transmission has two coaxial or concentric central gears and at least one transfer gear coupled to the central gears.

The transmission is arranged exactly or substantially between the roller and the handle, preferably in an annular space formed within the roller and closed by the handle.

Further advantageous embodiments result from combinations of the features disclosed in the description, figures and claims.

Terms and Definitions

The handle is used for handling the device or the roller grinder according to the invention. The handle is thus suitable to be held by the hand of a user while the roller grinder is moved over a base, i.e. pushed or drawn.

A roller grinder is a grinding device that can be moved in a rolling manner over a base so that a grinding and/or polishing disc is set in rotation to grind the cutting edge of a cutting tool held against the disc. The category of roller grinder was established, among others, by DE 297 03 326 U1 and was further developed by EP 3 278 928 A2.

DETAILED DESCRIPTION

A preferred embodiment of the present invention is described in detail below with reference to the accompanying drawings.

The present embodiment relates to a device 1, also referred to as a roller grinder, for grinding and/or polishing a cutting tool such as a household knife. This device 1 is configured to be moved in a rolling manner over a base U, and in so doing to set the grinding and/or polishing wheels 4 arranged on the end face in rotation, so that a cutting edge 9 of the cutting tool applied against the disc 4 is ground or polished. The principle of such roller grinders is basically known from the patent documents EP 3 278 928 A2 as well as DE 297 03 326 U1. The present description of the invention essentially explains the differences from the known roller grinders.

Figure 1:
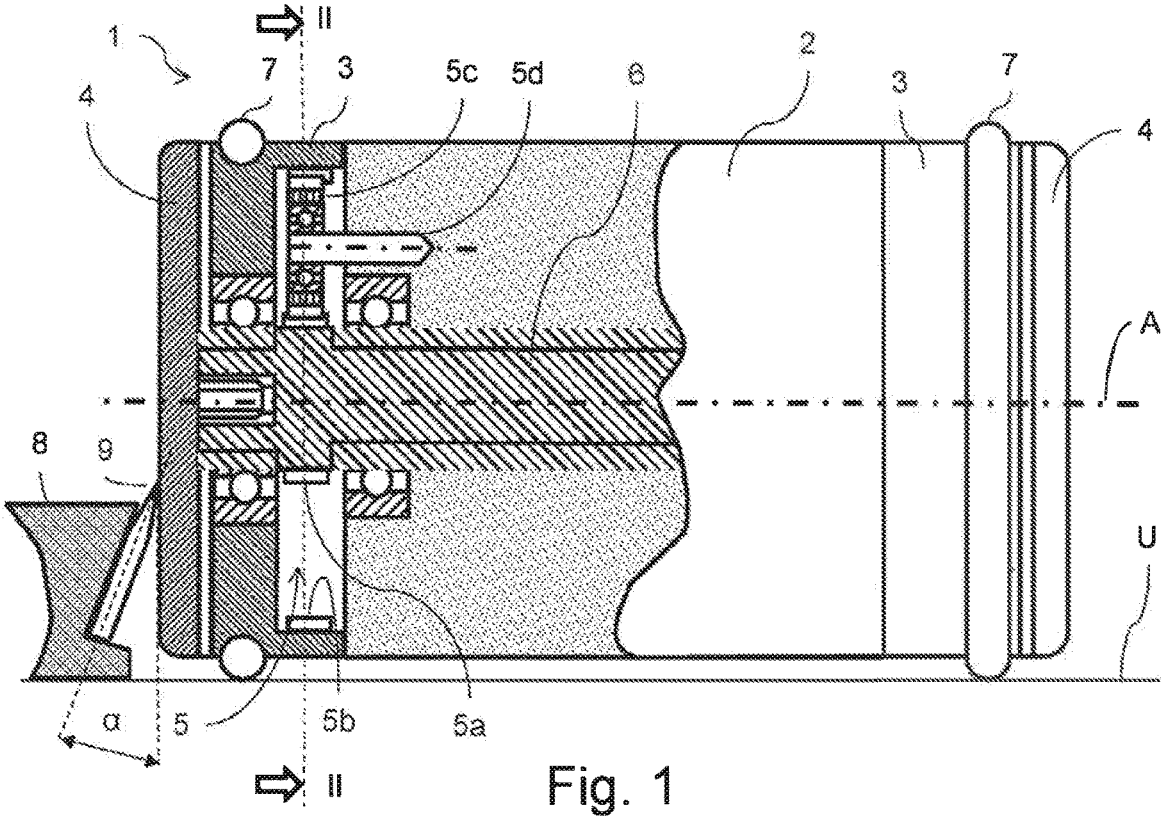
FIG. 1 shows a schematic partial sectional view of a device according to the invention according to the preferred embodiment, the left half of the image being shown in section along the center axis of the device and the right half of the image being shown as an external view of the device.
Figure 2:
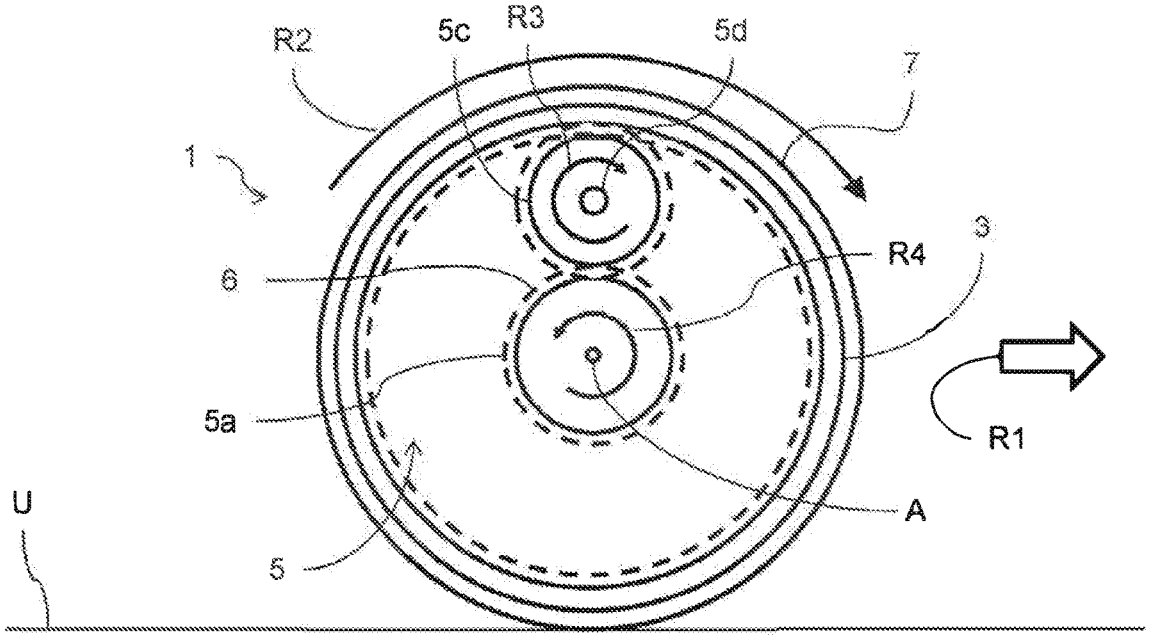
FIG. 2 a schematic cross-sectional view of the device according to the invention as shown in FIG. 1 along line II-II, the components of the device being shown in simplified form.

The roller grinder 1 according to the invention shown in FIGS. 1 and 2 comprises a hollow cylindrical handle 2 made of wood, two annular rollers 3 made of metal arranged on the end face of the handle 2 and rotatable relative to the handle 2, and two circular discs 4 made of metal, each arranged on the end face of the roller grinder 1 and rotatable relative to the handle 2 for grinding or polishing the cutting tool. Force is generally exerted on the handle 2 by the hand of a user, for example by traction or pressure, so that the roller grinder 1 is moved over a base U and the rollers 3 rotate relative to the handle 2 as they roll on the base U. Each disc 4 is screwed to an axle 6 rotatably mounted in the handle 2 via an integrally formed threaded pin and is connected to this axle 6 in a rotationally fixed manner.

The handle 2, the roller 3, the disc 4 and the axle 6 are arranged coaxially to each other, so that the axes of rotation A of the roller 3, the disc 4 and the axle 6 coincide with the center axis A of the device 1 or the handle 2.

Each of the two discs 4 arranged on the end face of the device 1 is coupled via its own transmission 5 to the roller 3 arranged between the disc 4 and the handle 2. The handle 2, the roller 3 and the disc 4 have identical outer diameters, so that the cylindrical shell surfaces of the handle 2, the roller 3 and the disc 4 are arranged flush with one another. Each roller 3 comprises a circumferential rubber ring 7 disposed in a groove on the outer circumference of the roller 3. Of all the components of the device 1, the rubber ring 7 has the largest diameter with respect to the center axis A of the device 1, so that when the device 1 is moved over the base U, the rubber ring 7 rolls on this base U.

In FIG. 1, the roller grinder 1 according to the invention is shown in a partial section along the center axis A of the device 1. As previously explained, the disc 4 arranged on the right-hand end face in FIG. 1 is also coupled to the associated roller 3 via a (concealed, preferably identical) transmission 5. Alternatively, however, it is also possible for the roller 3 and the disc 4 on the right end face to be coupled to each other in a rotationally fixed manner, i.e. without the interposition of a transmission, as is known from patent document EP 3 278 928 A2. The left and right discs 4 can also be coupled to the respective roller 3 via different transmissions or gear ratios.

Due to the transmission 5, the disc 4 is set in rotation by rotation of the associated roller 3 relative to the handle 2, so that when the roller 3 rotates, the disc 4 rotates at a different rotational speed/angular velocity than the roller 3. Depending on the gear ratio, the rotational speed/angular velocity of the disc 4 is preferably at least 50% higher than the rotational speed/angular velocity of the roller 3.

In the present embodiment, the transmission 5 is configured as a planetary gear. This planetary gear comprises two coaxial central gears 5*a*, 5*b* and at least one transmission gear 5*c* motion-coupled to the central gears 5*a*, 5*b*. In order to optimize the power transmission between the central gears 5*a*, 5*b* and distribute it evenly around the circumference of the roller 3, a plurality of planetary gears 5*c* can be arranged, preferably at regular angular intervals, around the axis of rotation A of the roller 3. The roller 3 is formed as a ring gear and comprises internal teeth on the inner circumference on the side facing the handle 2. This internal toothing is in mesh with an external toothing of the transmission gear 5*c*, the axis 5*d* of which is fixed relative to the handle 2 and offset parallel to the central axis A of the handle 2. The axle 6 has external teeth and is also in mesh with the transmission gear 5*c*.

When the roller grinder 1 rolls in the direction R1, as shown in FIG. 2, the roller 3 rotates by rolling on the base U in the direction R2. If the handle 2 is held by the hand of a user (not shown), the handle 2 does not rotate with respect to the base U when the roller 3 is rolling on the base U. Thus, the axis 5*d* of the transmission gear 5*c*, which is fixed with respect to the handle 2, remains stationary with respect to the base U and the axis of rotation A of the roller 3.

Due to the meshing between the internal teeth of the roller 3 and the external teeth of the transmission gear 5*c*, the rotational movement of the roller 3 in direction R2 is translated into the rotational movement of the transmission gear 5*c* in direction R3. The rolling or circumferential speeds of the gears in mesh in the area of the pitch circles are identical. However, since the transmission gear 5*c* has a significantly smaller gear or pitch diameter than the roller 3, the transmission gear 5*c* rotates about its axis 5*d* at a higher rotational speed/angular velocity than the roller 3 rotates about its axis A.

Via a further toothed engagement, the rotational movement of the transmission gear 5*c* is now transmitted to the axle 6, which is rotatably mounted in the handle 2 and is in turn non-rotatably connected to the disc 4. Since the gear or pitch diameters of the transmission gear 5*c* and the axle 6 are approximately equal, the rotational speed/angular velocity of the axle 6 is approximately equal to the rotational speed/angular velocity of the transmission gear 5*c*. In the present case, the rotational movements of the roller 3 and the respective adjacent disc 4 are coupled in such a way that when the roller 3 rotates relative to the handle 2, the disc 4 rotates in the opposite direction to the direction of rotation of the roller 3.

By selecting the gear or pitch diameters of the roller 3, the transmission gear 5*c* and the axle 6, the ratio of the rotational speed/angular velocity of the disc 4 relative to the roller 3 can be influenced.

In the present embodiment, the roller 3 and the disc 4 are coupled via the transmission 5, so that the roller 3 provides a mechanical drive for the disc 4.

If the device 1 is held by the handle 2 and moved over the base U, such as a table surface in the direction R1, the linear movement is converted into a rotational movement via the roller 3 rolling on the base U. The linear movement is then transmitted to the disc 4. Friction or gear contact with the roller 3 drives the transmission gear 5*c*, which then transmits its rotational movement to the axle 6 and the disc 4 connected to it.

However, it is also possible that the roller 3 and the disc 4 are mechanically decoupled from each other, whereby, for example, a sensor detects the rotational movement of the roller 3 and outputs a signal to a control unit which, based on the signal output by the sensor, controls a motor to generate the rotational movement of the disc 4 so that the roller 3 and the disc 4 rotate at different rotational speeds relative to each other. Accordingly, the transmission 5 is not an essential feature of the device 1.

The following embodiments are essentially based on the first embodiment shown in FIGS. 1 and 2 and have identical features except for the differences mentioned below.

In a second embodiment, the grinding wheel is thicker than in the first embodiment and has a circumferential groove for the rubber ring on the outer circumference. If the rubber ring is moved from the groove on the outer circumference of the roller 3 shown in FIG. 1 into the groove on the outer circumference of the grinding wheel 4, the rolling speed of the roller grinder 1 changes.

In a third embodiment, the roller grinder 1 has a motor-driven grinding or polishing disc 4 at at least one end, which is driven, for example, by an electric drive and is supplied with energy from a battery or accumulator.

In a fourth embodiment, the roller grinder 1 has a spring winder motor at at least one end as the drive for the transmission 4. This enables higher rotational speeds for polishing the knife flanks.

The invention claimed is:

1. A device for grinding and/or polishing a cutting edge of a cutting tool, comprising:

a handle;

at least one roller rotatable relative to the handle; and at least one disc rotatable relative to the handle for grinding and/or polishing the cutting edge of the cutting tool, the at least one disc being arranged on one end face of the device, wherein the device is movable over a base by exerting force on the handle, so that the roller rotating relative to the handle rolls on the base and the disc can be set in rotation, and wherein the disc is rotatable at a different rotational speed/angular velocity than the roller.

2. The device according to claim 1, wherein the disc rotates at a different rotational speed/angular velocity than the roller when the roller rotates relative to the handle.

3. The device according to claim 2, wherein the disc rotates at a greater rotational speed/angular velocity than the roller when the roller rotates relative to the handle, the rotational speed/angular velocity being at least 50% greater than the rotational speed/angular velocity of the roller.

4. The device according to claim 1, wherein the disc rotates in the same direction or in an opposite direction to the direction of rotation of the roller when the roller rotates relative to the handle.

5. The device according to claim 1, wherein the disc rotates with a fixed or adjustable transmission ratio with respect to the roller when the roller rotates with respect to the handle.

6. The device according to claim 1, wherein the rotational movements of the roller and the disc are coupled via a gear, and the gear is either a toothed gear or a planetary gear.

7. The device according to claim 6, wherein the gear has two coaxial central gears and at least one transmission gear motion-coupled to the central gears.

8. The device according to claim 7, wherein the roller and the disc are connected or coupled in a rotationally fixed manner to one of the central gears, and an axis of rotation of the at least one transmission gear is offset relative to the axes of rotation of the central gears with respect to the handle.

9. The device according to claim 6, wherein the roller is a ring gear having internal teeth.

10. The device according to claim 1, wherein the device has an axle rotatably mounted on or in the handle, the axle being set in rotation upon rotation of the roller relative to the handle, the disc is connected to the axle in a rotationally fixed and/or detachable manner, and the roller is rotatably mounted on the axle.

11. The device according to claim 10, wherein the axes of rotation of the roller, the disc and the axis coincide with a central axis of the handle.

12. The device according to claim 1, wherein the handle, the roller, the disc, and the axle are arranged coaxially to each other.

13. The device according to claim 1, wherein the at least one disc comprises two discs is arranged on the two end faces of the device, the at least one roller comprises two rollers, where each of said two rollers is arranged between one of said two discs and the handle, each of the two discs has its own drive and is coupled via its own transmission to the roller arranged between said disc and the handle.

14. The device according to claim 1, wherein the handle, the roller, and the disc have exactly or substantially identical outer diameters such that shell surfaces of the handle, the roller, and the disc are arranged flush with one another.

15. The device according to claim 1, wherein the roller has a circumferential rubber ring that is arranged in at least one groove on the outer circumference of the roller, the rubber ring having the largest diameter with respect to an axis of the device, so that the rubber ring rolls on the base when the device is moved over the base.

16. A system comprising the device according to claim 1 and a device for fixing the cutting edge of the cutting tool relative to the disc during grinding and/or polishing such that a flank and/or extension plane of the cutting edge of the cutting tool is oriented relative to the disc at an angle in the range from 5° to 30°.

* * * * *